United States Patent [19]

White

[11] 4,194,799

[45] Mar. 25, 1980

[54] MOUNTING UNIT FOR FREE ARM SEWING MACHINE

[76] Inventor: Eugene M. White, 1624 Franklin Ave., Fort Wayne, Ind. 46808

[21] Appl. No.: 921,955

[22] Filed: Jul. 5, 1978

[51] Int. Cl.[2] ..... A47B 81/00; A47B 29/00

[52] U.S. Cl. ..... 312/21; 312/22; 312/27; 312/319; 112/217.1

[58] Field of Search ..... 312/21, 22, 26, 27, 312/29, 30, 208, 319; 112/217.1; 108/37, 136

[56] References Cited

U.S. PATENT DOCUMENTS

| | | | |
|---|---|---|---|
| Re. 28,835 | 6/1976 | Roberts et al. | 312/22 |
| 2,037,479 | 4/1936 | Mossner | 312/21 |
| 2,712,973 | 7/1955 | James | 312/26 |
| 2,790,690 | 4/1957 | James | 312/319 |
| 3,264,046 | 8/1966 | Preuss | 312/26 |
| 3,432,039 | 3/1969 | Howitt | 108/136 |
| 3,986,755 | 10/1976 | Kohara | 312/21 |
| 4,005,918 | 2/1977 | Smith et al. | 312/27 |
| 4,089,573 | 5/1978 | Aeschliman | 312/27 |

FOREIGN PATENT DOCUMENTS

| | | | |
|---|---|---|---|
| 1809290 | 6/1970 | Fed. Rep. of Germany | 112/217.1 |

*Primary Examiner*—Victor N. Sakran

*Attorney, Agent, or Firm*—Albert L. Jeffers; John F. Hoffman

[57] ABSTRACT

A mounting mechanism for a free arm sewing machine which is moveable selectively to an upper use position wherein the free arm is positioned above the work surface of the cabinet, a lower use position wherein the free arm is flush with the cabinet work surface, and a storage position wherein the entire machine is disposed below the work surface. The mechanism comprises a frame, a sewing machine support platform, and first and second pivot arms which are pivotally connected to the frame and the platform such that the platform is capable of limited rotating and swinging movement relative to the frame. The platform is latched in its upper use and lower use positions by means of a pair of spaced plates having forwardly and upwardly opening slots therein, which are adapted to releaseably retain and support either a pair of protruding pins on the platform or, in an alternative embodiment, one of the pivot arms which extends around the plates. One of either the frame or platform pivots is translatable within a slot so that the arm or platform, respectively, can move in and out of the latched position. The provision of a sliding pivot also avoids inoperative binding of the mechanism, which would otherwise occur as it moves from one position to another.

30 Claims, 21 Drawing Figures

MOUNTING UNIT FOR FREE ARM SEWING MACHINE

BACKGROUND OF THE INVENTION

The present invention relates to a mechanism for mounting a free arm sewing machine in a work cabinet, and in particular to a mechanism whereby the machine is selectively supported in two work positions, one wherein the free arm is disposed above the cabinet work surface, and the other wherein the free arm is flush with the work surface. The mechanism also has a storage position in which the entire machine is contained within the cabinet beneath the work surface in a space-efficient manner.

A free arm sewing machine is generally employed for sewing garments having a generally tubular configuration, such as trouser legs, sleeves, and the like. To sew this type of garment, it is slipped over the free arm, which is a narrow appendage positioned above the bed or base of the machine.

A sewing machine of this type may also be used in the same fashion as a conventional flatbed machine wherein the needle plate is at the same level as the work surface of the cabinet. In order for the machine to assume this position, the machine is lowered so that the upper surface of the free arm is substantially flush with the work surface of the cabinet. Since the free arm is narrower and shorter than the cabinet opening, inserts are customarily positioned between it and the sides of the cabinet opening. This provides a continuous work surface flush with the needle plate and the machine may be utilized in the same manner as a conventional flatbed machine.

A conventional feature in sewing machine cabinets is a mechanism whereby the machine may be dropped to a lower storage position thereby enabling a hinged cover to be folded over the opening of the cabinet work surface. It is desirable for the machine to be rotated to a horizontal position when it is stored, as this normally results in greater economy of space.

Although mounting assemblies for supporting free arm sewing machines in a storage position and two work positions are known, they are often quite complex and difficult to operate.

One prior art free arm cabinet presently on the market comprises a first pair of pivot arms pivotally secured to the back of the cabinet and the machine mounting bracket, and a second pair of pivot arms positioned respectively above the first arm and pivotally secured to the back of the cabinet and the mounting bracket. The machine is supported on the pivot arms in two use positions and a storage position. In the storage position, however, the machine is inclined upwardly from the horizontal so that it occupies approximately thirteen inches of depth as opposed to the present invention wherein the required storage depth is no greater than the width of the supporting platform, for example, approximately seven inches.

The present invention constitutes an improvement over the mounting mechanism disclosed in copending application Ser. No. 808,099 filed June 20, 1977 in the name of Eugene M. White. This mechanism, like the mechanism of the present invention, comprises a pair of pivot arms pivotally connected to the cabinet and to the supporting platform or bracket for the sewing machine wherein the machine is supported by the arms in upper and lower use positions, and in a storage position wherein the machine is rotated to a horizontal position just beneath the cabinet work surface. In order to avoid inoperative binding, which would lock the mechanism against movement at various points in its movement between the three positions discussed above, one of the hinges is permitted to move relative to the pivot at the other end of the pivot arm. A further feature of that mechanism, is its ability to unlatch from the lower use position by shifting the machine to an orientation wherein binding of the pivot arms occurs. When the binding occurs, the arms will be pulled inwardly away from the stops which support them in the lower use position and enable it to drop into the storage position.

SUMMARY OF THE INVENTION

The present invention constitutes an improvement over the free arm mechanism disclosed in the aforementioned copending application and is concerned primarily with the means for latching the mechanism in the upper and lower use positions. This is accomplished by providing two pairs of notches or keepers in a pair of spaced vertical plates, which are adapted to retain and support either one of the arms or a pair of retaining members rigidly connected to the machine support platform. The arm or retaining pins are capable of being moved in and out of the notches by virtue of a sliding pivot between the arm and supporting frame, or between the arm and the platform. The mechanism is unlatched by urging three of the pivots toward mutually coplanar positions wherein binding would normally occur, but, due to the sliding pivot, forces the pivot out of its normal path of rotation so that the retaining pin or arm will be forced out of the latch.

Specifically, the present invention contemplates a mounting mechanism for a free arm sewing machine comprising: a frame, a sewing machine support platform, a first pivot arm connected to the frame about a first pivot for rotation about a first axis, first means pivotally connecting the platform to the first pivot arm about a second pivot for rotation about a second axis parallel to the first axis, a second pivot arm pivotally connected to the frame about a third pivot for rotation about a third axis parallel to the first and second axes, second means pivotally connecting the platform to the second pivot arm about a fourth pivot for rotation about a fourth axis parallel to the first, second and third axes, said platform being moveable relative to the frame selectively to an upper use position, a lower use position below the upper use position, and a storage position generally below the lower use position. Latch means are provided for latching the platform in one of its upper use and lower use positions and for unlatching the platform when three of the pivots are urged toward mutually coplanar positions.

Another feature of the present invention is the lift mechanism, which enables the machine to "float" from one position to the next with minimal manual effort. The lift mechanism, which comprises a pair of interconnected springs cooperating between an anchor point and a lever arm connected to one of the pivot arms, produces increasing lifting force as the machine is raised from its storage position to the lower use position and to the upper use position. The lifting force is a minimum in the storage position, where it is least needed, and reaches a maximum as the machine is moved between the lower use position and the upper use position, at which time the full weight of the machine is acting downwardly against the pivot arms.

The variable lifting force is achieved by means of a first spring coiled around a lever arm connected either to the axis of one of the pivot arms, or to the axis of a third lift arm, which engages the lower side of the machine support platform. A second spring is connected to one of the coils of the first spring and is tensioned between it and an anchor point. As the machine moves into the storage position, the lever arm is oriented such that the first spring is compressed, thereby reducing the moment of rotational force exerted on the lift arm or pivot arm. In moving between the lower use and upper use positions, the first spring extends such that the tension exerted by the second spring is at a greater distance away from the axis of rotation of the lift arm or pivot arm, thereby producing maximum moment of rotational force.

Specifically, the mounting mechanism according to this aspect of the invention comprises: a frame, a sewing machine support platform, a first pivot arm rotatably connected to the frame and platform, a second pivot arm rotatably connected to the frame and platform, said platform being moveable on the arms selectively to an upper use position, a lower use position below the upper use position, and to a storage position generally below the lower use position, an automatic lift means exerting resilient rotational force on one of the arms for biasing the arm to rotate in a direction to urge the platform upwardly, the moment of rotational force exerted on the arm increasing with the movement of the platform upwardly in a direction away from the storage position.

It is an object of the present invention to provide an improved mounting unit for a free arm sewing machine wherein the machine is selectively supported in an upper use position with the free arm disposed above the cabinet work surface, in a lower use position wherein the top surface of the free arm is flush with the cabinet surface, and the storage position wherein the entire machine is disposed beneath the cabinet surface in a space efficient manner.

Another object of the present invention is to provide a mounting unit for a free arm sewing machine which is of simple and efficient construction thereby minimizing manufacturing costs and increasing reliability.

Yet another object of the present invention is to provide a cabinet mounting unit for a free arm sewing machine requiring no more space for storage than conventional flatbed machines.

A further object of the present invention is to provide a mounting unit for free arm sewing machines including a lift mechanism for enabling the machine to be raised and lowered from one position to another with a minimum of manual effort, and wherein the lift force on the machine is at a maximum where it is most needed.

A still further object of the present invention is to provide a mounting mechanism for free arm sewing machines wherein the machine is latched in and unlatched from its upper and lower use positions by simple tilting movements of the machine and without the necessity for additional locking devices.

A still further object of the present invention is to provide a free arm mounting unit which can be easily installed in existing flatbed sewing machine cabinets.

These and other objects and features of the invention will become more apparent from the following description taken together with the accompanying drawings.

DETAILED DESCRIPTION

Figure 1:
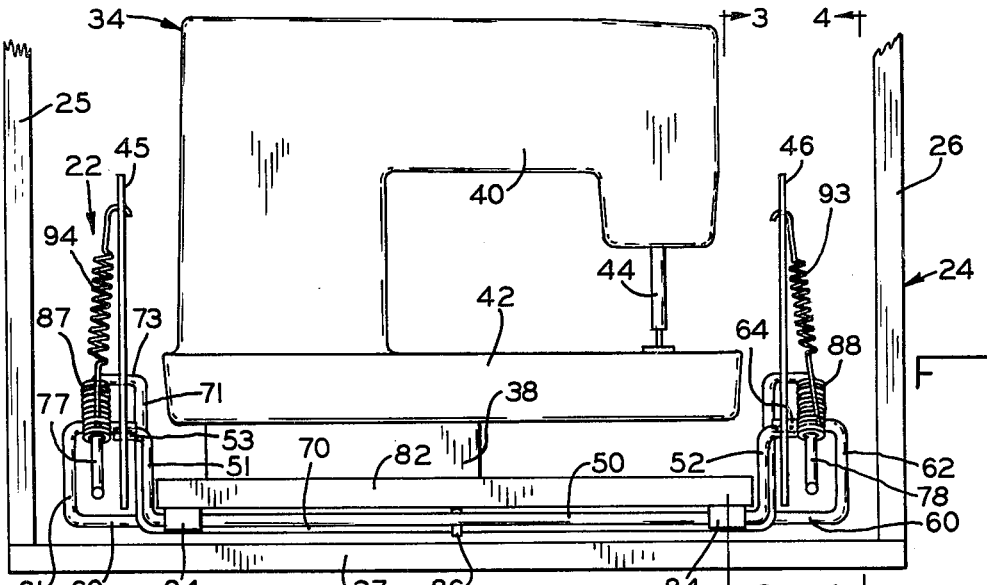
FIG. 1 is a plan view of the mounting mechanism according to the present invention mounted within a sewing machine cabinet and having a free arm machine mounted thereto, and wherein the mechanism is in the storage position.

Referring now in detail to the drawings, the mounting mechanism 22 of the present invention is shown installed in a conventional sewing machine work cabinet 24 having sides 25 and 26, front 27, back 28 and an upper work surface 30. Cabinet 24 is normally constructed of wood and has a hinged cover (not shown) secured to top 30 and adapted to be folded thereover. An opening 32 in top 30 provides access for the sewing machine 34 and enables it to be shifted between its storage position and upper and lower use positions. A conventional flipboard 36 is hingedly connected to top 30 and serves the dual purpose of closing the gap in opening 32 and supporting the machine 34 in the upper use position.

The sewing machine 34 to which the present invention is adapted is a free arm machine having a base 38, arm 40 and free arm 42. As shown, free arm 42 is integrally connected to machine 34 at one end and extends above the level of base 38 toward needle assembly 44 parallel with arm 40. Machine 34 is completely conventional and forms no part of the present invention.

A pair of steel vertical plates 45 and 46 are secured to top 30 and depend therefrom. Rear pivot arm 48, which may comprise a bent steel rod, has a center segment 50, a pair of side segments 51 and 52 oriented at 90° relative to center segment 50, and a pair of end segments 53 and 54 which are parallel to center segment 50 and extend through aligned openings 56 in plates 45 and 46, in which they are rotatably received. Rear pivot arm 48, therefore, is capable of rotational movement relative to plates 45 and 46 which, together with cabinet 24, comprise a stationary frame.

Front pivot arm 58 is a steel rod bent to formation and comprises a center segment 60, a pair of side segments 61 and 62 oriented at 90° to center segment 60, and a pair of end segments 63 and 64, which are parallel to center segment 60. End segments 63 and 64 are received in a pair of aligned slots 66 in plates 45 and 46, and are capable of rotational and sliding movement therein. Front arm 58, therefore, is rotatably connected to plates 45 and 46.

Mechanism 22 is also advantageously provided with a lift arm 68 consisting of a steel rod bent to formation and comprising a center segment 70, a pair of side segments 71 and 72 oriented 90° to center segment 70, a pair of end segments 73 and 74 parallel to center segment 70, and a pair of lever arms 77 and 78 integrally connected with end segments 73 and 74, respectively, and oriented 90° to center segment 70. End segments 73 and 74 are rotatably received in a pair of aligned openings 80 in plates 45 and 46 so that lift arm 68 is rotatable about an axis coincident with end segments 73 and 74.

The free ends of pivot arms 48 and 58 may be provided with caps in order to prevent their sliding out of their respective openings. Rather than being bent metal rods, arms 48 and 58 may comprise discrete segments which are connected together by welding or suitable connectors.

Figure 2:
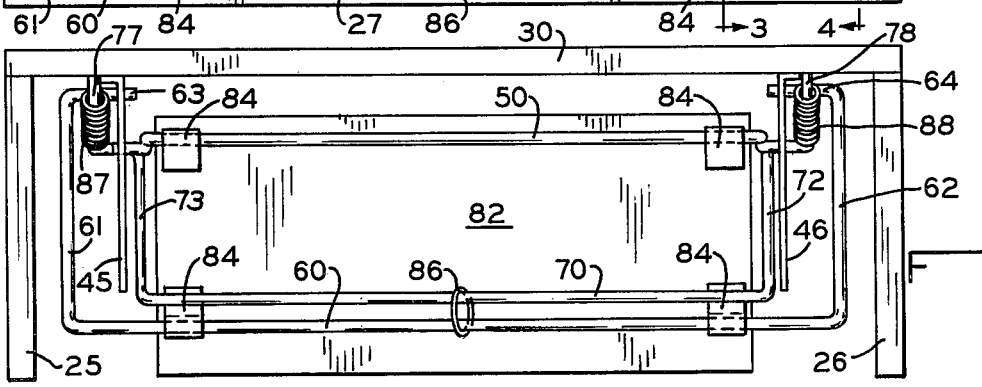
FIG. 2 is a rear elevational view of the mechanism in the storage position of FIG. 1.
Figure 3:
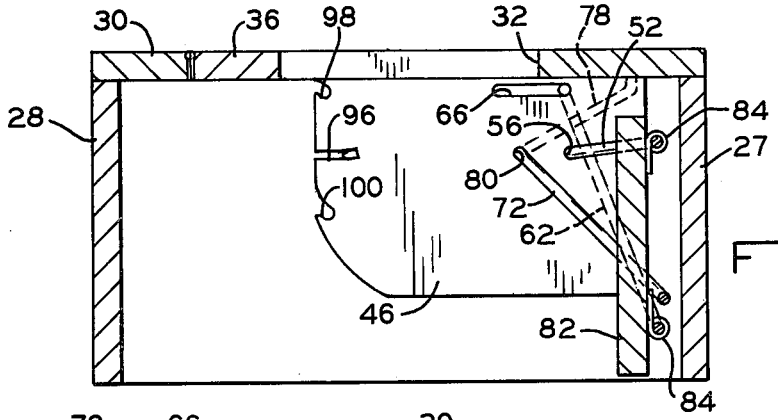
FIG 3 is a sectional view of FIG. 1 taken along line 3—3 and viewed in the direction of the arrows.

A flat mounting platform 82, to which sewing machine 34 is mounted, is pivotally connected to the center segments 50 and 60 of front and rear arms 48 and 58 respectively, by means of hinges 84 (FIG. 2). Hinges 84 may comprise flat strips of metal secured to platform 82 having semi-circular recesses therein in which the center segments 50 and 60 of rods 48 and 58 are rotatably received. Front pivot arm 58 and lift arm 68 are loosely connected together by means of a ring 86, which serves to constrain lift arm 68 to follow front pivot arm 58 during movement of the mechanism. By virtue of the relationship between platform 82 and arms 48 and 58, platform 82 is free to rotate about the axes defined by the center segments 50 and 60 of rear and front pivot arms 48 and 58.

Coiled around lever arms 77 and 78 are compression springs 87 and 88, which have one end 89 and 90 thereof anchored in place so that they will not move relative to arm 77 and 78. For example, the anchored ends 89 and 90 may be welded or otherwise secured to the axis ends of lever arms 77 and 78 or, alternatively, connected to plates 45 and 46. The opposite ends 91 and 92 of springs 87 and 88 are free to slide relative to lever arms 77 and 78 so that springs 87 and 88 may be compressed.

A second pair of springs 93 and 94, which are expansion springs, are hooked at one end into one of the coils of springs 87 and 88, respectively, and are hooked into forwardly opening slots 96 in plates 45 and 46. As will be described in greater detail hereafter, as lever arms 77 and 78 swing rearwardly, springs 93 and 94 will compress springs 87 and 88 so that the moment of rotational force exerted on lift arm 68 will be reduced.

Plates 45 and 46 each include an upper forwardly opening notch or slot 98 adapted to retain and support front arm 58 when the mechanism 22 is in the upper use position, and a lower forwardly opening notch or slot 100, which is adapted to retain and support front arm 58 when the mechanism 22 is in the lower use position.

It should be noted that the invention is not limited to the precise apparatus disclosed. For example, rods 48, 58 and 68 could be pivotally connected to the base of machine 34 itself, so that platform 82 may be eliminated and the base 42 of machine 34 would therefore become the "platform". For the purposes of the present application, the "platform" is that assemblage of elements rigidly connected to machine 34.

The operation of mechanism 22 will now be described.

Figure 4:
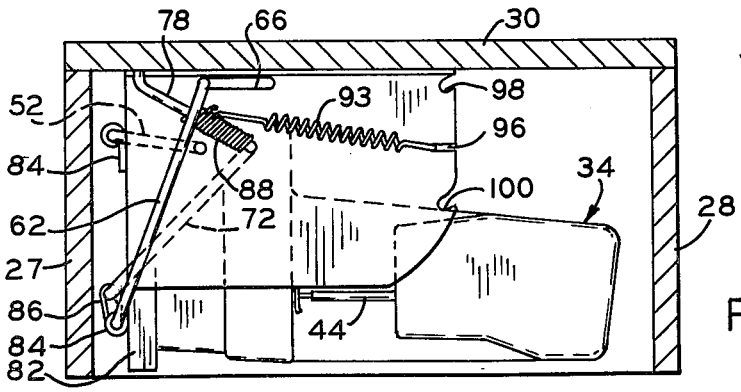
FIG. 4 is a sectional view taken along line 4—4 of FIG. 1 and viewed in the direction of the arrows.
Figure 6:
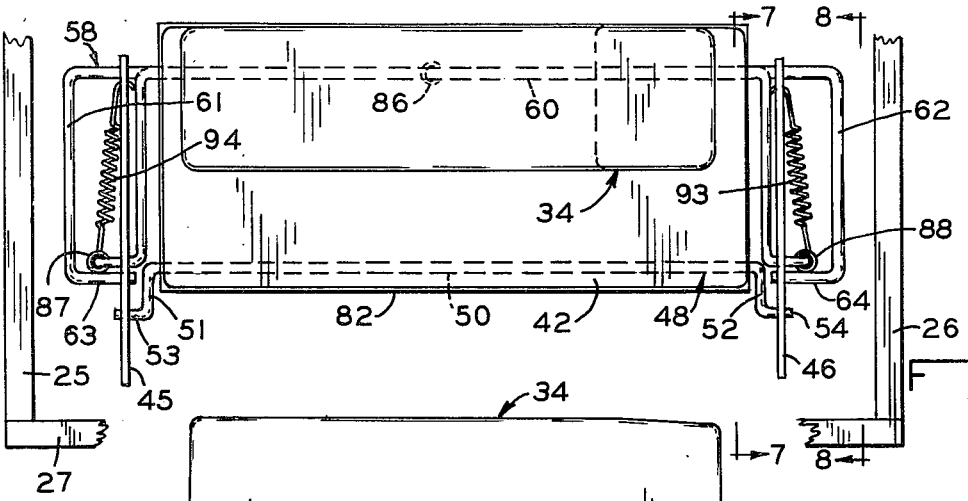
FIG. 6 is a plan view of the mounting mechanism, cabinet and sewing machine of the previous Figures, wherein the mechanism is in the lower use position.
Figure 5:
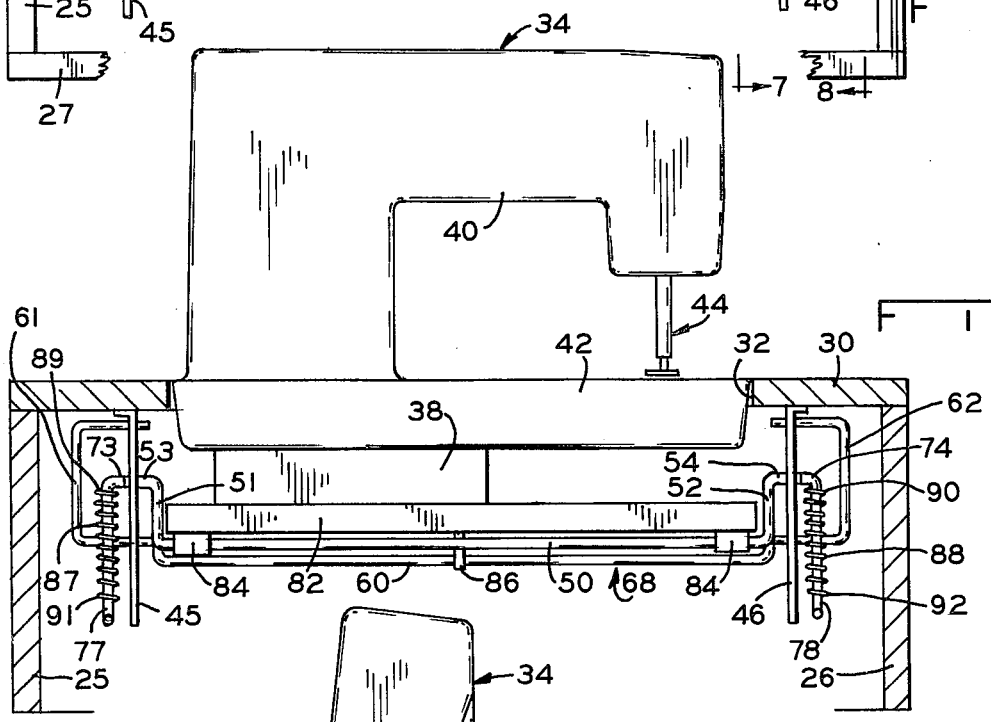
FIG. 5 is a partially sectional front elevational view of the mechanism in the lower use position.
Figure 8:
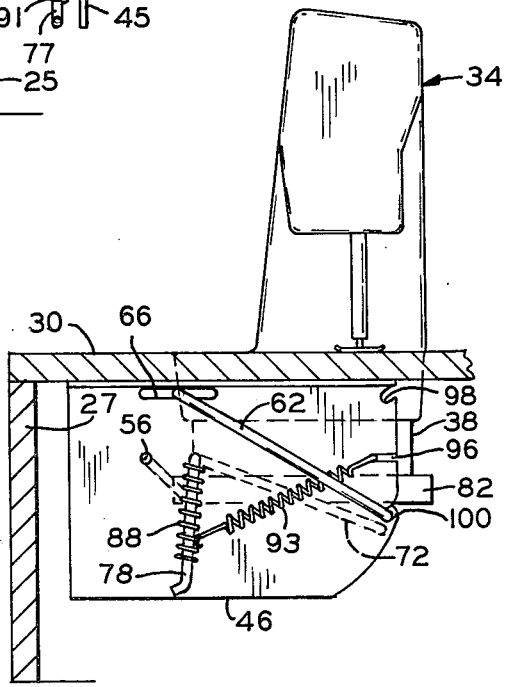
FIG. 8 is a sectional view taken along line 8—8 of FIG. 6 and viewed in the direction of the arrows.
Figure 7:
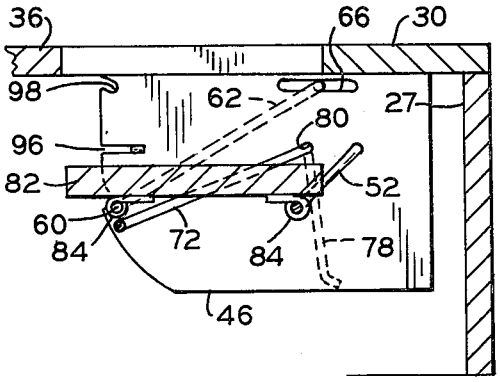
FIG. 7 is a sectional view taken along line 7—7 of FIG. 6 and viewed in the direction of the arrows.

In the storage position shown in FIGS. 1 through 4, the sewing machine 34 is horizontal and is suspended from plates 45 and 46 by pivot arms 48 and 58. With machine 34 horizontal and positioned immediately below top 30, this results in the most efficient and economical utilization of storage space, as opposed to many prior art mechanisms wherein the machine is diagonally oriented in the storage position. It will be noted that in the storage position, tension spring 93 compresses spring 88 such that the moment of rotational force exerted on lift arm 68 is at a minimum, the moment of rotational force being the product of the rotational vector of force exerted by spring 93 and the distance to the axis of rotation of lift arm 68. In this position, lift arm 68 is slightly over center as illustrated in FIG. 4 and there is no chance that the tension of the springs could cause the machine to be inadvertently raised out of the storage position.

To move the machine 34 from the storage position of FIGS. 1 through 4 to the lower use position of FIGS. 5 through 8 in which the free arm 42 is flush with the upper surface of top 30, the arm 40 of machine 34 is grasped and pulled upwardly. This causes lift arm 68 to rotate over center, and at this point, the tension of spring 93 will assist in raising the machine from the storage position. This motion is continued until the center segment 60 of front arm 58 is positioned just in front of lower notch or keeper 100. Front arm 58 is able to assume this position because of the sliding pivot comprising slots 66 and end segments 63 and 64. If it were not for this arrangement, inoperative binding of arms 48 and 58 would occur thereby preventing further movement.

With the mechanism in this position, machine 34 is tilted rearwardly and pushed downward slightly so that the center segment 60 of front arm 58 will slip into lower notch 100. In this position, it will be noted that compression spring 88 has been extended by virtue of the increased angle between lever arm 78 and spring 93. This increases the moment of rotational force at a point where the weight of machine 34 is acting downwardly against arms 48 and 58 and results in the effective resistance to movement of the mechanism and machine to be substantially constant during movement from the storage position to the lower use position.

To unlatch the mechanism 22 from this position, the machine 34 is tilted forward slightly so as to urge the center segments of front and rear arms 58 and 48 and the end segments 53 and 54 of rear arm 48 toward mutually coplanar positions. Except for the provision of slot 66, such movement would result in inoperative binding of the mechanism due to the differences in radii of rotation of arms 48 and 58. The sliding pivot afforded by slots 66, however, causes front arm 58 to be pushed forwardly and out of lower notch 100. At this point, the mechanism 22 is free to be either dropped to its storage position or raised to its upper use position.

It is important to note that the mechanism 22 is latched and unlatched simply by tilting the machine 34 and does not require an additional latching mechanism. Front arm 58 is positioned in front of notches 100 by moving three of the pivots toward mutually coplanar positions which causes the front arm to be pushed forwardly. To latch the mechanism, front arm 58 is pulled rearwardly by moving the three pivots away from mutually coplanar positions. The three pivots in the case of the mechanism described above comprise the center segment 60 of front arm 58, the center segment 50 of rear arm 48 and the end segments 53 and 54 of rear arm 48. It is the movement of the arms 48 and 58 toward the aforementioned binding positions which forces one of the arms out of its normal path of rotation.

Figure 9:
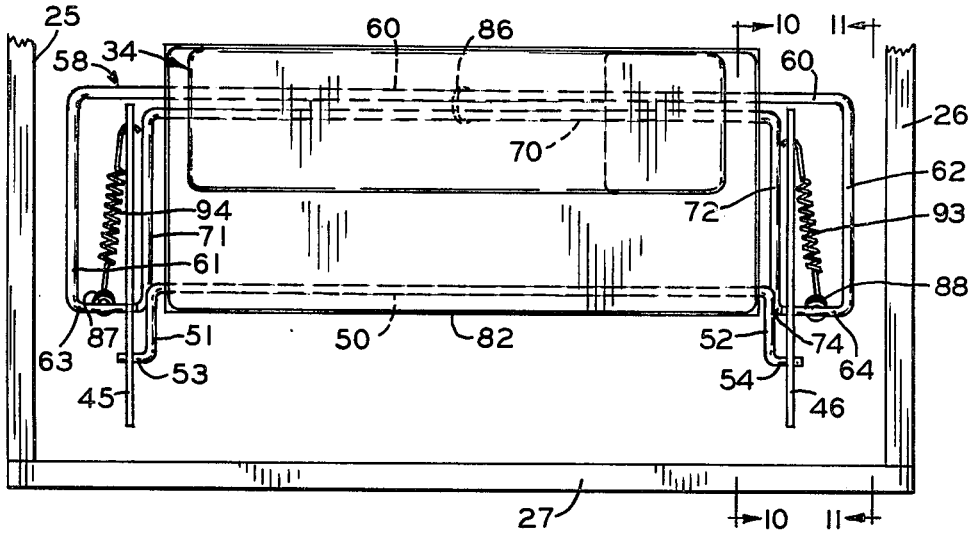
FIG. 9 is a plan view of the mounting mechanism, cabinet and machine or the previous Figures wherein the mechanism has just been unlatched from the lower use position.
Figure 10:
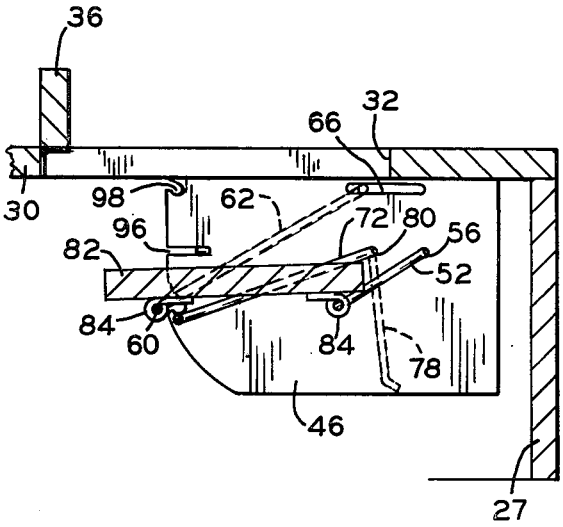
FIG. 10 is a sectional view taken along line 10—10 of FIG. 9 and viewed in the direction of the arrows.
Figure 11:
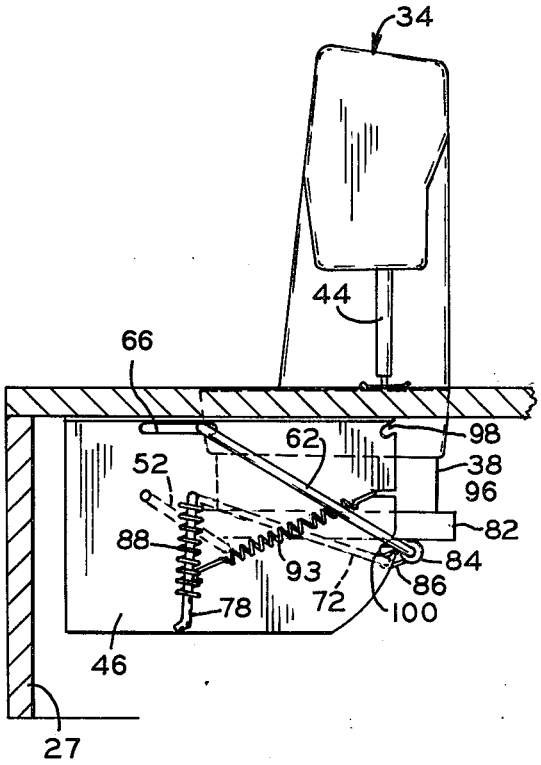
FIG. 11 is a sectional view taken along line 11—11 of FIG. 9 and viewed in the direction of the arrows.
Figure 12:
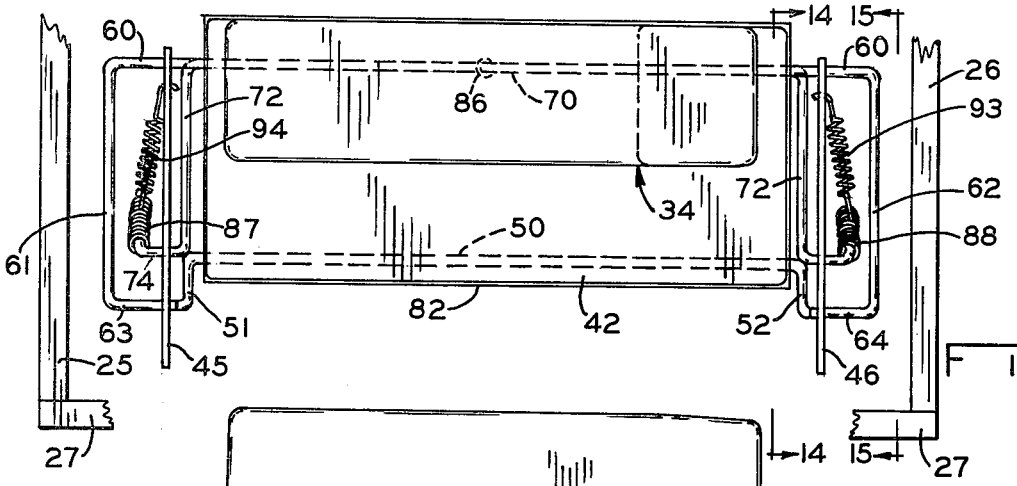
FIG. 12 is a plan view of the mounting mechanism, cabinet and sewing machine of the previous Figures wherein the mechanism is in the upper use position.
Figure 13:
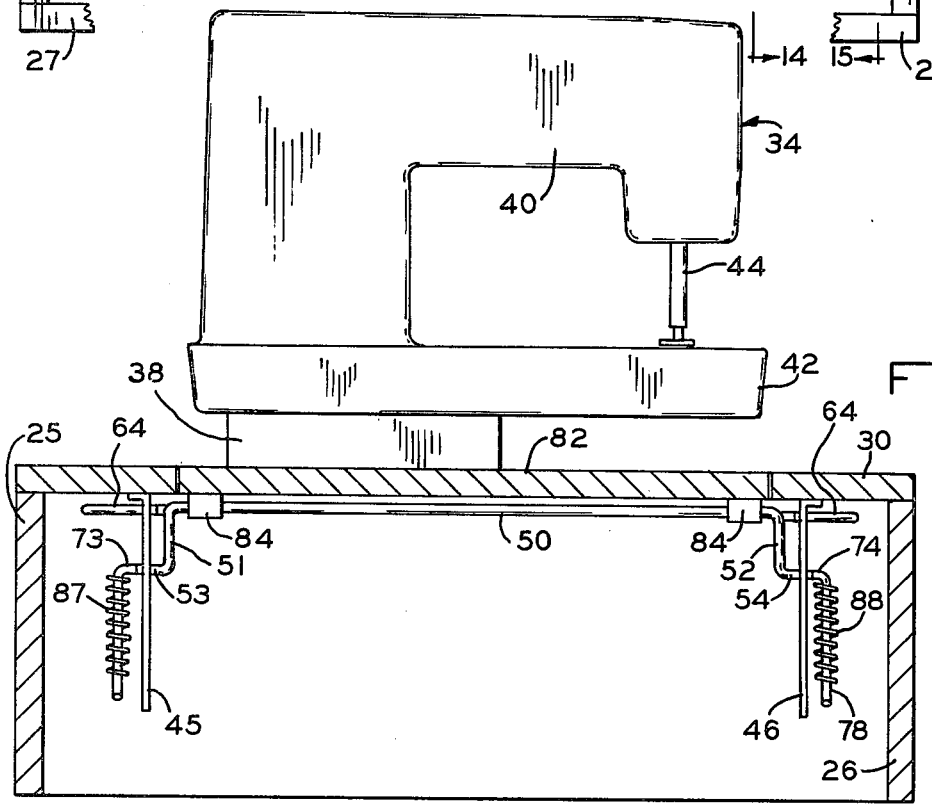
FIG. 13 is a partially sectioned rear elevational view of the mechanism in the upper use position of FIG. 12.

To move the machine from the lower use position to the upper use position, wherein the free arm 42 is spaced above the top 30, machine 34 is tilted forwardly to push front arm 58 out of lower notch 100 to the position shown in FIGS. 9, 10 and 11. Machine 34 is then pulled upwardly until front arm 58 is positioned just forwardly of upper notches 98 and machine 34 is tilted forwardly to cause front arm 58 to be pulled rearwardly and into upper notches 98. This last tilting motion serves to move the three aforementioned pivots further away from mutually coplanar positions and causes front arm 58 to be pulled rearwardly such that its end segments 63 and 64 also slide rearwardly in slots 66. As a further safety measure to prevent machine 34 from dropping out of this position, flip board 36 may be lowered. It will be seen that this prevents platform 82 from shifting forwardly.

Figure 16:
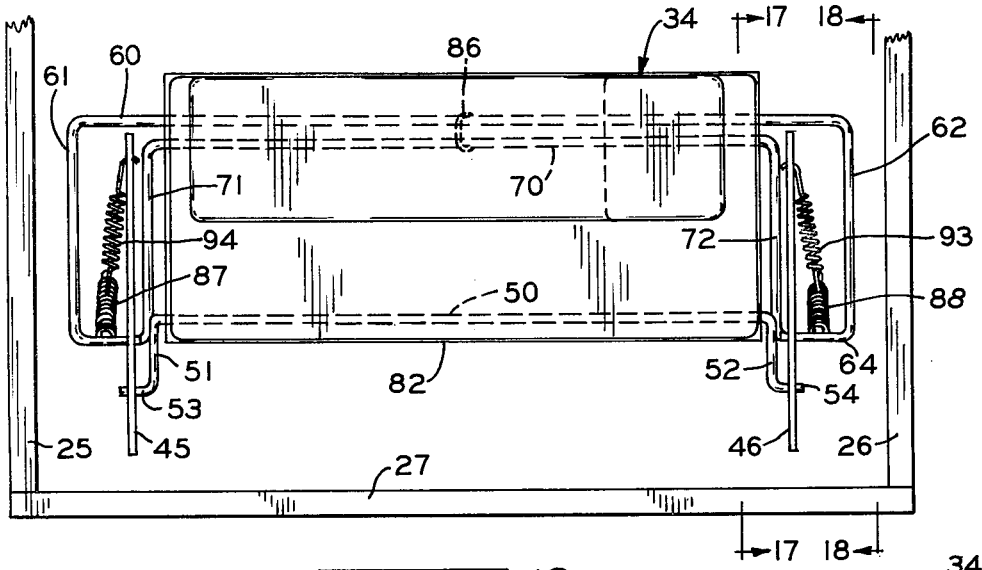
FIG. 16 is a plan view of the mechanism, cabinet and sewing machine wherein the mechanism has just become unlatched from the upper use position.
Figures 17, 18:
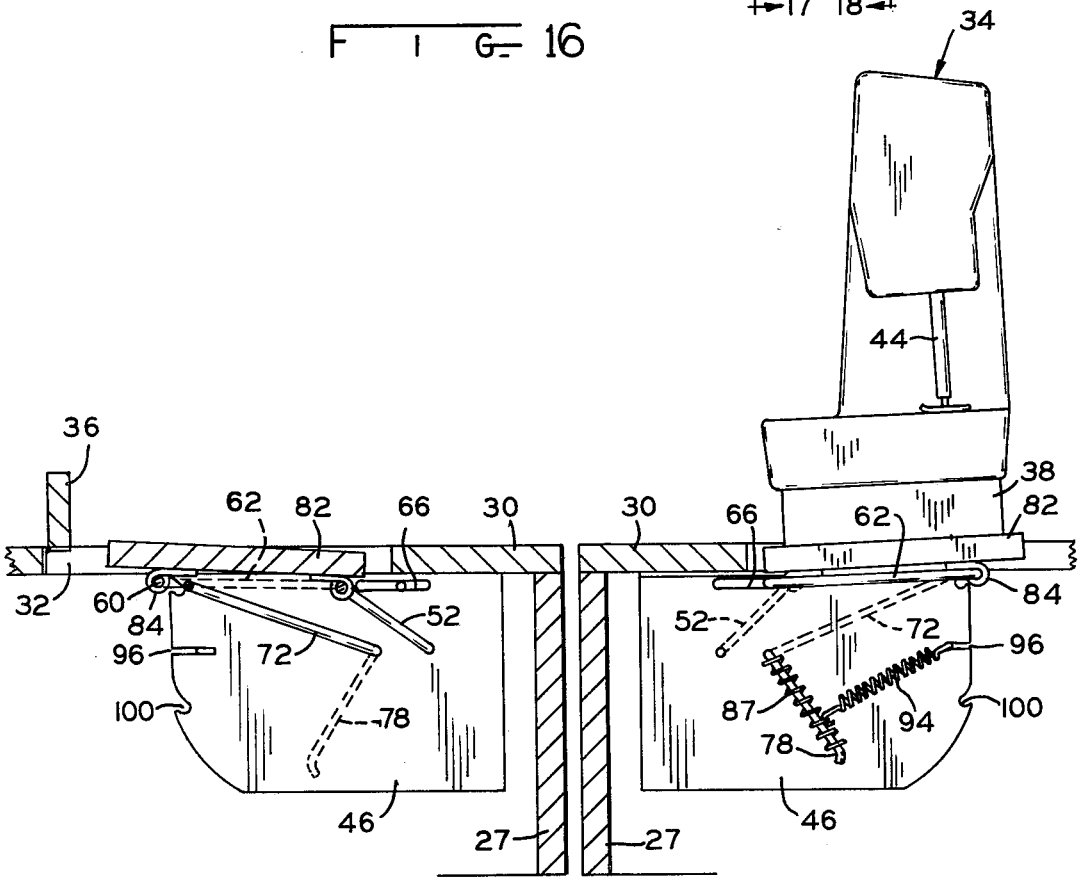
FIG. 17 is a sectional view taken along line 17—17 of FIG. 16 and viewed in the direction of the arrows.
FIG. 18 is a sectional view taken along line 18—18 of FIG. 16 and viewed in the direction of the arrows.

To lower the machine out of the upper use position shown in FIGS. 13, 14, 15 and 19, machine 34 is tilted rearwardly thereby urging the center segments 60 and 50 of front and rear arms 58 and 48, respectively, and the end segments 54 of rear arm 48 toward mutually coplanar positions. The binding action (which would otherwise occur except for the sliding pivot) achieved by this movement forces front arm 58 forwardly and out of upper notch 98, thereby permitting mechanism 22 and machine 34 to drop. This position is illustrated in FIGS. 16, 17 and 18.

It should be noted that near the upper use position shown in FIGS. 12, 13, 14 and 15, compression springs 87 and 88 are extended to the greatest degree thereby increasing the moment of rotational force exerted on lift arm 68. This provides the greatest lifting force in the movement between the lower use and upper use positions and, as mentioned previously, results in the effective lifting being substantially uniform throughout the movement of the mechanism 22 and machine 34 between the three positions. Although there is a greater lifting force exerted between the upper and lower use positions, the lifting assistance which is perceived by the user is substantially the same throughout.

Figure 20:
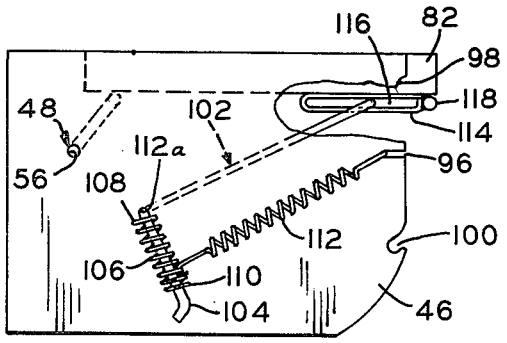
FIG. 20 is a sectional view similar to FIG. 18 of an alternative embodiment of the invention wherein a portion thereof has been broken away to illustrate the details of construction.
Figure 21:
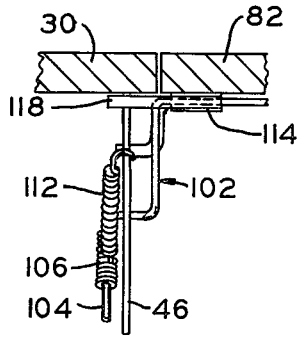
FIG. 21 is a partially sectioned front elevational view of the mounting mechanism of FIG. 20.
Figure 15:
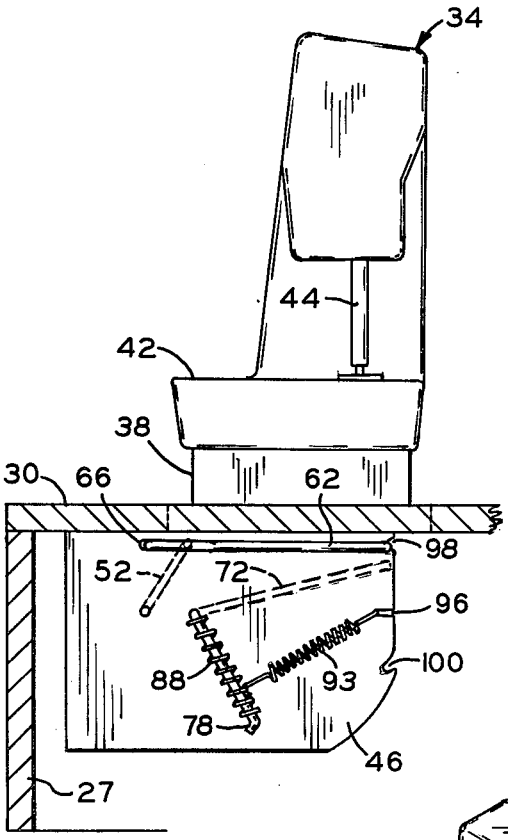
FIG. 15 is a sectional view taken along line 15—15 of FIG. 12 and viewed in the direction of the arrows.
Figure 14:
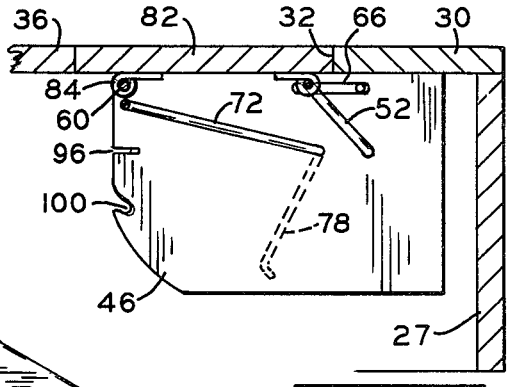
FIG. 14 is a sectional view taken along line 14—14 of FIG. 12 and viewed in the direction of the arrows.
Figure 19:
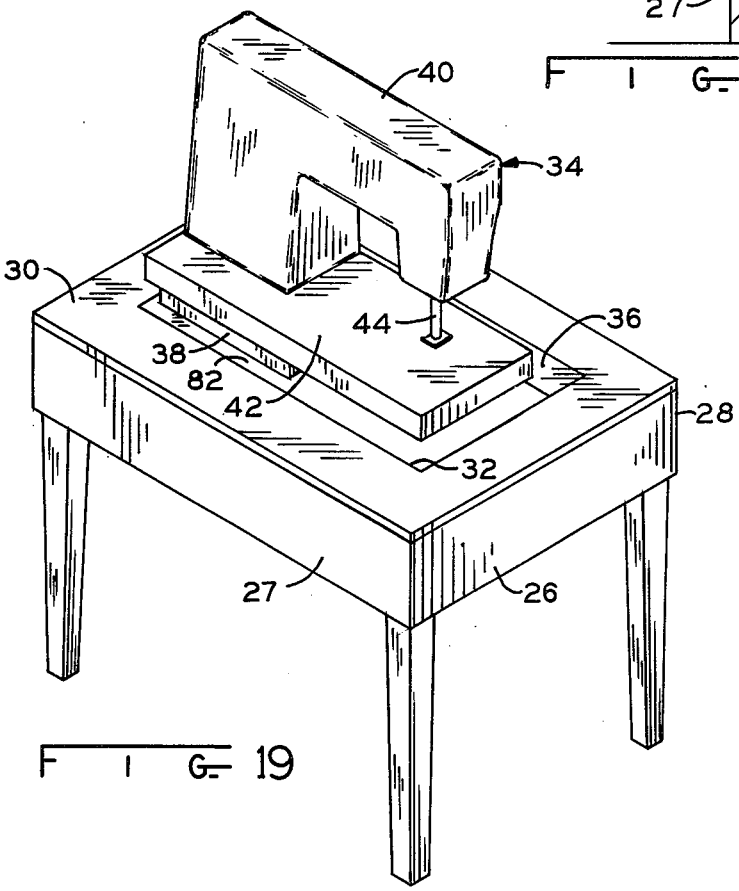
FIG. 19 is a perspective view of the mounting mechanism, cabinet and sewing machine of the previous Figure wherein the mechanism is in the upper use position.

A modified form of the invention is illustrated in FIGS. 20 and 21, and is characterized by the elimination of lift arm 68. In this case, front arm 102 has its sliding pivot at the plates thus enabling the front arm to act also as the lift mechanism. Front arm 102 has been modified by the addition of a pair of lever arms 104, which are integral with front arm 102 and extend from the axis thereof at an angle of approximately 90°. The compression spring 106 is coiled around arm 104 and, like the previous embodiment, is anchored at one end 108 and free to move at the other end 110. Tension spring 112 is connected between one of the coils of compression spring 106 and slot 96. It will be noted that the pivot point for front arm 102 has been lowered somewhat to approximately the same position as the pivot for lift arm 68 in the previous embodiment. Slot 66 has been replaced by a rotational opening **112*a* so that front arm 102 is capable of only rotational movement rather than the rotational/sliding movement as before. Rear pivot arm 48 is identical and pivots within opening 56 in plate 46**.

Platform 82 includes sliding bracket members 114 having elongated openings 116 therein and a protruding pin 118 welded or otherwise secured to bracket 114 and extending outwardly from each side of platform 82 and in front of respective plates 45 and 46. Although only one of these brackets 114 is shown in FIG. 20, it should be noted that two of them are provided at the opposite ends of the platform 82 proper. The center segment of front arm 102 extends through the openings 116 in brackets 114 and underneath the platform 82 proper. Thus, platform 82 is capable of limited sliding movement so that the pivot defined by the end segments 54 of rear arm 48 can move relative to the pivot defined by the center segment of front arm 102 and brackets 114.

Front arm 102 is urged to rotate in the counterclockwise direction as viewed in FIG. 20 by virtue of spring 112, which exerts an increasing moment of rotational force as platform 82 is moved away from the storage position upwardly through the lower use position to the upper use position. In the storage position, spring 106 will be compressed so that the effective length of the lever arm is short. In the upper use position illustrated in FIG. 20, on the other hand, spring 106 will be extended to a maximum so that the effective length of the lever arm will also be at a maximum and the moment of rotational force will be the greatest. Thus, front arm 102 serves the dual function of providing rotational and sliding support for platform 82 and also the lifting force therefor.

In operation, the mechanism is unlatched from the upper use position by tilting machine 34 rearwardly so as to urge the pivots defined by the center segment of front arm 102, the end segments 53 and 54 of rear arm 48 and the center segment 50 of rear arm 48 in directions toward mutually coplanar positions. This pushes platform 82 forwardly thereby causing pins 118 to move out of upper notches 98. Just the opposite action will cause pins 118 to move into upper notches 98, when it is desired to latch the mechanism 22 in the upper use position.

To latch mechanism 22 in the lower use position, platform 82 and machine 34 are lowered until the center segment of front arm 102 is positioned just in front of lower notch 100. Machine 34 is then tilted rearwardly so as to move the three pivots in directions away from mutually coplanar positions, thereby causing platform 82 to be pulled rearwardly so that the center segment of front arm 102 is received in notch 100. Just the reverse motion will cause unlatching of mechanism 22 from the lower use position, and permit it to be dropped downwardly into the storage position.

As used in the claims, the term "spatially related pivots" refers to pairs of pivots which are normally not moveable toward or away from each other, except for the provision of a single sliding pivot which enables this to occur. In the first embodiment of the invention described above, for example, the pivots defined by the center segment 50 and end segments 53 and 54 of rear arm 48 are not moveable toward or away from each other because they are connected by a rigid member, namely, side segments 51 and 52. For purposes of the present application, these pivots are "spatially related pivots". Similarly, the pivots defined by the center segment 50 of rear arm 48 and the center segment 60 of front arm 58 are "spatially related pivots" because they are not moveable toward or away from each other by virtue of their rigid interconnection through platform 82. Except for the provision of slot 66, the pivots defined by the end segments 53 and 54 of rear arm 48 and the end segments 63 and 64 of front arm 58 would not be moveable toward or away from each other, and are therefore considered "spatially related pivots". Inoperative binding of mechanism 22 is avoided by permitting the pivot comprising slot 66 and end segments 63 and 64 to slide so as to be moveable relative to its spatially related pivot defined by end segments 53 and 54. As discussed in detail above, this movement also permits latching of front arm 58 in notches 98 and 100. The other pair of spatially related pivots comprise the center segment 60 of front arm 58 and the end segments 63 and 64 thereof.

In the alternative embodiment of FIGS. 20 and 21, the spatially related pivots comprising center segment 50 of rear arm 48 and the center segment of front arm 102 are permitted to move relative to each other by virtue of the elongated openings in brackets 114 in which front arm 102 slides.

The term "frame" represents the supporting structure for the pivot arms and other parts of the mechanism.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A mounting mechanism for a free arm sewing machine comprising:

a frame, a sewing machine support platform, a first pivot arm connected to said frame about a first pivot for rotation about a first axis, first means pivotally connecting said platform to said first pivot arm about a second pivot for rotation about a second axis parallel to said first axis, a second pivot arm pivotally connected to said frame about a third pivot arm for rotation about a third axis parallel to said first and second axes, second means pivotally connecting said platform to said second pivot arm about a fourth pivot for rotation about a fourth axis parallel to said first, second and third axes, said platform being moveable relative to said frame selectively to an upper use position, a lower use position below said upper use position, and a storage position generally below said lower use position, and latch means for latching said platform in one of its upper use and lower use positions and for unlatching said platform when three of said pivots are urged toward mutually coplanar positions.

2. The mounting mechanism of claim 1 wherein:

said first and second pivots are spatially related pivots with respect to each other, said third and fourth pivots are spatially related pivots with respect to each other, said second and fourth pivots are spatially related pivots with respect to each other, said first and third pivots are spatially related pivots with respect to each other, said means for unlatching comprises means for enabling one of said pivots and its axis of rotation to translate relative to one of its spatially related pivots.

3. The mounting mechanism of claim 2 wherein said means for enabling comprises a slot in one of said frames and said platform in which one of said pivots is slidably and rotatably received.

4. The mounting mechanism of claim 3 wherein said latch means includes a keeper which retains and supports a portion of said mechanism when said platform is latched.

5. The mounting mechanism of claim 4 wherein said means for enabling comprises a slot in said frame in which one of said first and third pivots is slidably and rotatably received.

6. The mounting mechanism of claim 4 wherein said means for enabling comprises a slot in said platform in which one of said first and third pivots is slidably and rotatably received.

7. The mounting mechanism of claim 4 wherein said latch means releasably latches said platform in the other of said upper and lower use positions, and said keeper comprises a pair of open slots in said frame adapted to releasably retain one of said arms.

8. The mounting mechanism of claim 4 including:

a third pivot arm pivotally connected to said frame about a fifth pivot, third means pivotally connecting said platform to said third arm for rotation about a sixth pivot coaxial with said third pivot, a fourth pivot arm pivotally connected to said frame for rotation about a seventh pivot coaxial with said third pivot, fourth means pivotally connecting said platform to said fourth pivot arm for rotation about an eighth pivot coaxial with said fourth pivot, said fifth and sixth pivots being spatially related pivots with respect to each other, said seventh and eighth pivots being spatially related pivots with respect to each other, said sixth and eighth pivots being spatially related pivots with respect to each other, and said fifth and seventh pivots being spatially related pivots with respect to each other, said latch means includes a second keeper which retains and supports one of said arms when said platform is latched, said means for unlatching comprises means for enabling one of said fifth, sixth, seventh and eighth pivots to translate relative to one of its said spatially related pivots so as to cause its respective said arm to move out of said second keeper when three of said fifth, sixth, seventh and eighth pivots are urged toward mutual coplanar positions with respect to one of said fifth and seventh pivots.

9. The mounting mechanism of claim 1 wherein said platform is latched by keeper means for releasably retaining and supporting one of said pivot arms.

10. The mounting mechanism of claim 1 wherein said frame comprises a sewing machine cabinet having a pair of downwardly extending plates to which said pivot arms are attached.

11. The mounting mechanism of claim 1 including:

a third pivot arm pivotally connected to said frame and to said platform, and spring means for rotationally resiliently biasing said arm in a direction to urge said platform upwardly.

12. The mounting mechanism of claim 11 wherein said spring means comprises means for increasing the moment of rotational bias with the movement of said platform away from said storage position toward said upper use position.

13. A mounting mechanism for a free arm sewing machine comprising:

a frame, a sewing machine support platform, a first pivot arm connected to said frame about a first pivot for rotation about a first axis, first means pivotally connecting said platform to said first arm about a second pivot for rotation about a second axis parallel to said first axis, a second pivot arm pivotally connected to said frame about a third pivot for rotation about a third axis parallel to said first and second axes, second means pivotally connecting said platform to said second pivot arm about a fourth pivot for rotation about a fourth axis parallel to said first, second and third axes, said platform being moveable relative to said frame selectively to an upper use position, a lower use position below said upper use position, and a storage position generally below said lower use position, said first and second pivots being spatially related pivots, said third and fourth pivots being spatially related pivots with respect to each other, said second and fourth pivots being spatially related pivots with respect to each other, and said first and third pivots being spatially related pivots with respect to each other, latch means on said frame for releasably retaining and supporting against gravity a retaining element fixedly connected to either said first and second arms or said platform, and means for enabling one of said pivots and its axis to be translatable relative to one of its spatially related pivots thereby causing said retaining element to move out of said latch means as said second and fourth pivots are urged in directions toward mutually coplanar positions with one of said first and third pivots, said one of said first and third pivots being other than said translatable pivot.

14. The mounting mechanism of claim 13 wherein said means for enabling comprises a slot in one of said frames and said platform in which one of said first and second pivots are respectively, slideably and rotatably received.

15. The mounting mechanism of claim 13 wherein:

said frame comprises a cabinet having a pair of vertical plates secured thereto, said pivot arms are secured to said plates, said latch means comprises an upwardly opening slot in respective forward edges of said plates adapted to receive a pair of said elements, said means for enabling comprises a slot in one of said platform and said plates in which said first pivot pair and said second pivot respectively is slideably and rotatably received.

16. The mounting mechanism of claim 15 wherein said first pivot comprises a pair of pivots slideably and rotatably received in slots in said plates, and said retaining element comprises a segment of said first arm.

17. The mounting mechanism of claim 15 wherein said second pivot is slideably and rotatably received in a slot in said platform, and said retaining element comprises a protrusion on said platform.

18. The mounting mechanism of claim 13 wherein said platform comprises a planar support, and said arms comprise generally U-shaped arms supportingly connected to said planar support.

19. In a sewing machine cabinet, a mounting mechanism for free arm sewing machines comprising:

a machine support platform, a pair of spaced apart vertical plates on respective sides of said platform, a first generally U-shaped pivot arm member having outwardly extending ends rotatably received in respective aligned openings in said plates such that said first arm member rotates about a first axis coincident with said openings, said platform being rotatably connected to said first arm member for rotation about a second axis parallel to said first axis, a second generally U-shaped pivot arm member having outwardly extending ends rotatably received in respective aligned second openings in said plates such that said first arm member rotates about a first axis coincident with said second openings and parallel to said first and second axes, said platform being rotatably connected to said second arm member for rotation about an axis parallel to said first, second and third axes, each of said plates having a pair of forwardly opening slots in the respective forward edges thereof adapted to releasably retain and support said first pivot arm member, said first openings in said plates comprising slots so as to permit said first pivot pair to translate relative to said plates whereby said first pivot arm member is capable of moving in and out of said forward edge slots.

20. The mounting mechanism of claim 19 wherein said first arm extends around the outer sides of said plates and in front of said plate forward edges.

21. In a sewing machine cabinet, a mounting mechanism for free arm sewing machines comprising:

a machine support platform, a pair of spaced apart vertical plates on respective sides of said platform, a first generally U-shaped pivot arm member having outwardly extending ends rotatably received in respective aligned openings in said plates such that said first arm member rotates about a first axis coincident with said platform being rotatably connected to said first arm member for rotation about a second axis parallel to said first axis, a second generally U-shaped pivot arm member having outwardly extending ends rotatably received in respective aligned second openings in said plates such that said first arm member rotates about a first axis coincident with said second openings and parallel to said first and second axes, said platform being rotatably connected to said second arm member for rotation about an axis parallel to said first, second and third axes, a pair of retaining elements fixedly connected to opposite sides of said platform and extending laterally outwardly past said plates, each of said plates having a pair of forwardly opening slots in respective forward edges thereof and adapted to releasably retain and support respective said retaining elements, and a pair of slots in said platform in which said first arm member is slideably and rotatably received such that said platform can translate relative to said first arm member so as to move said retaining elements in and out of said forward edge slots.

22. In a sewing machine cabinet, a mounting mechanism for free arm sewing machines comprising:

a machine support platform, a pair of spaced apart vertical plates connected to said cabinet and positioned on respective sides of said platform, a first generally U-shaped pivot arm member rotatably connected to said plates for rotation about a first axis, said platform being rotatably connected to said first arm member for rotation about a second axis parallel to said first axis, a second generally U-shaped pivot arm member rotatably connected to said plates for rotation about a third axis parallel to said first and second axes, said platform being rotatably connected to said second arm member for rotation about an axis parallel to said first, second and third axes, a pair of retaining elements fixedly connected to opposite sides of said platform and extending laterally outwardly past said plates, each of said plates having at least one forwardly opening slot adapted to retain and support a respective one of said retaining elements, a pair of slots in said platform in which said first arm member is slideably and rotatably received such that said platform can translate relative to said first arm member so as to move said retaining elements in and out of said forward edge slots, a lever arm connected to said first arm member, and spring means connected between said lever arm and said frame for resiliently biasing said first arm member in a direction to urge said platform upwardly.

23. The mounting mechanism of claim 22 wherein said spring means comprises a first spring coiled around said lever arm coaxially with said lever arm, and a second spring connected between said first spring and a stationary anchor point.

24. A mounting mechanism for a free arm sewing machine comprising:

a frame, a sewing machine support platform, a first pivot arm rotatably connected to said frame and said platform, a second pivot arm rotatably connected to said frame and said platform, said platform being movable on said arms selectively to an upper use position, to a lower use position below said upper use position, and to a storage position generally below said lower use position, and automatic lift means exerting resilient rotational force on one of said arms for biasing said one arm to rotate in a direction to urge said platform upwardly, the moment of rotational force exerted on said one pivot arm increasing with the movement of said platform upwardly in a direction away from the storage position, said lift means comprising a spring connected to said frame, and variable moment means connected to said one pivot arm for connecting said spring to said one pivot arm at a distance from the axis of rotation of said one pivot arm which increases as said platform moves away from the storage position toward the upper use position.

25. The mounting mechanism of claim 24 wherein said rotational force is greatest in or near the upper use position.

26. The mounting mechanism of claim 25 wherein said rotational force is greater in the lower use position than in the storage use position and less than in the upper use position.

27. The mounting mechanism of claim 24 wherein said variable moment means comprises a second spring axially coiled around said lever arm and free to expand and contract along said lever arm, said first mentioned spring is connected to said second spring.

28. The mounting mechanism of claim 27 wherein said second spring is compressed by said first spring as said platform moves downwardly toward the storage position.

29. The mounting mechanism of claim 1 wherein said variable moment means comprises a second spring axially coiled around said lever arm and free to move along said lever arm, and said first spring is connected to said second spring.

30. The mounting mechanism of claim 24 wherein said one pivot arm is U-shaped and includes a lever arm connected to said one pivot arm at the axis of rotation thereof, and said automatic lift means is connected to said lever arm.

* * * * *